US007419446B2

(12) United States Patent
Nguyen

(10) Patent No.: US 7,419,446 B2
(45) Date of Patent: Sep. 2, 2008

(54) MULTI-COMPONENT BAT AND ASSEMBLY PROCESS

(76) Inventor: Thu Van Nguyen, 24128 Hillhurst Dr., West Hills, CA (US) 91307

( * ) Notice: Subject to any disclaimer, the term of this patent is extended or adjusted under 35 U.S.C. 154(b) by 0 days.

(21) Appl. No.: 11/468,023

(22) Filed: Aug. 29, 2006

(65) Prior Publication Data

US 2008/0058132 A1 Mar. 6, 2008

(51) Int. Cl.
*A63B 59/06* (2006.01)

(52) U.S. Cl. ..... 473/567; 473/566

(58) Field of Classification Search ..... 473/564–568, 473/519, 520, 457
See application file for complete search history.

(56) References Cited

U.S. PATENT DOCUMENTS

| | | | | |
|---|---|---|---|---|
| 4,819,935 | A * | 4/1989 | Dirksing et al. | 482/109 |
| 4,907,800 | A * | 3/1990 | Passamaneck et al. | 473/457 |
| 6,010,415 | A * | 1/2000 | Miggins | 473/437 |
| 6,050,908 | A * | 4/2000 | Muhlhausen | 473/457 |
| 6,099,422 | A * | 8/2000 | Rappaport et al. | 473/567 |
| 6,432,006 | B1 * | 8/2002 | Tribble | 473/564 |
| 6,485,382 | B1 * | 11/2002 | Chen | 473/566 |
| 6,511,392 | B1 * | 1/2003 | Chohan | 473/564 |
| 6,729,983 | B1 * | 5/2004 | Vakili et al. | 473/566 |
| 6,824,482 | B1 * | 11/2004 | Tribble | 473/564 |
| 6,863,628 | B1 * | 3/2005 | Brandt | 473/520 |
| 7,166,046 | B1 * | 1/2007 | Liu | 473/567 |
| 2003/0069095 | A1 * | 4/2003 | Turos | 473/457 |
| 2004/0224801 | A1 * | 11/2004 | Forsythe et al. | 473/564 |
| 2005/0261075 | A1 * | 11/2005 | Pullaro | 473/256 |
| 2006/0252586 | A1 * | 11/2006 | Nguyen | 473/564 |
| 2007/0142135 | A1 * | 6/2007 | Cheng | 473/564 |
| 2007/0191156 | A1 * | 8/2007 | Van Nguyen | 473/564 |
| 2007/0207882 | A1 * | 9/2007 | Van Nguyen | 473/564 |

* cited by examiner

*Primary Examiner*—Mark S Graham
(74) *Attorney, Agent, or Firm*—Kelly Lowry & Kelley, LLP

(57) ABSTRACT

Assembling a multi-component baseball bat includes disposing a rigid sleeve coaxially over a portion of an elongate composite handle. The rigid sleeve encircles a second end of the handle and extends toward a first end of the handle. A ring is positioned near a second end of a bat barrel. A first end of the bat barrel is inserted into the second end of the handle; the first end of the bat barrel being secured within the second end of the handle. An illustrative bat includes an elongate composite handle and an elongate barrel, each having opposite first and second ends. The first end of the barrel is disposed within the second end of handle. A mechanism secures the first end of the barrel within the second end of the handle. A rigid sleeve encircles the second end of the handle, extending towards the first end thereof.

45 Claims, 8 Drawing Sheets

10
4,6,8
24,124
20,120,
226
46,146,
246
4,6,8
22,122,
222
30,130,
230
28,128,
228
66,166,
266
72,172,
272
70,170,
270
80,180,
280
9
64,164,
264
24,154,
224
46,146,
246
3,5,7

22,122,
222
50,150,
250
28,128,
228

MULTI-COMPONENT BAT AND ASSEMBLY PROCESS

BACKGROUND OF THE INVENTION

The present invention relates to baseball and softball bats. More particularly, the present invention relates to a multi-component bat and a related assembly process.

Baseball and softball are very popular sports in the United States, Mexico, Cuba, Japan and elsewhere. Due to the competitive nature of the sports, players are constantly seeking ways of improving their performance. An important aspect of baseball and softball is the ability to effectively hit the ball. Aluminum (metal) bats are allowed in baseball amateur play from Little League to College levels. Metal bats are also typically used in slow and fast pitch softball. Such bats are advantageous over wood bats in that they do not break and splinter like wood bats and thus can be repeatedly used with consequent cost savings. Metal bats also have a larger optimal hitting area or power zone (commonly referred to as the "sweet spot") than wood bats. Furthermore, the ball comes off a metal bat faster than a wood bat resulting in longer hits.

However, metal bats have certain disadvantages. Metal bats vibrate upon impact and may send painful vibrations into the hands and arms of the batter if the ball is not hit within the power zone of the bat. Metal bats, particularly aluminum bats, may also dent or otherwise deform due to forceful impacts with the ball. Metal bats also emit an undesirable high-pitched metallic sound, as opposed to the traditional sound heard when a wood bat contacts the ball.

Various attempts have been made to overcome the problems associated with metal bats. Some attempts have been to coat or wrap the exterior of the metal bat with materials such as carbon reinforcing fibers to enhance batting performance. These externally wrapped bats have been found to be aesthetically unpleasant and lacking in significant improvement. Other attempts have been made to insert internal layers or compartments within the metal bat to improve performance. Bats have been devised that incorporate both metal and composite materials. Such designs include utilizing multiple-layered graphite inserts to provide durability and flexibility to the bat, tubular coiled spring steel inserts to improve the springboard effect when the ball contacts the bat, and pressurized air chambers within the bat. Bats that incorporate composite materials tend to be much lighter than metal bats. While providing benefits, these designs also have drawbacks. Some designs are very expensive to manufacture and are prone to structural failure. The composite sheaths break down over time, the bats are subject to premature longitudinal cracks in the barrel of the bat and damage is created at an interface of the metal and composite materials due to differences in the impact absorption and resistance characteristics of the materials.

Accordingly, there is a need for a bat which enhances the performance of the bat and overcomes the disadvantages previously experienced with metal bats. The present invention fulfills these needs and provides other related advantages.

SUMMARY OF THE INVENTION

The present invention resides in an apparatus and process that provides a multi-component bat. As illustrated herein, a multi-component baseball bat embodying the present invention includes an elongate composite handle having opposite first and second ends. The bat further includes an elongate barrel having opposite first and second ends, the first end of the barrel being disposed within the second end of handle. A mechanism is provided for securing the first end of the barrel within the second end of the handle. The bat also includes a ring disposed near the second end of the barrel, and a rigid sleeve encircling the second end of the handle and extending toward the first end of the handle.

The sleeve is adhered to an exterior of the handle and barrel. The sleeve comprises, at least in part, an intermediate tapered section between the barrel and handle.

The securing mechanism includes a section of the handle enveloping an end of the barrel. The securing mechanism also includes an annular recess in the handle for receiving the sleeve therein.

A portion of the handle is disposed between the sleeve and barrel. The first end of the barrel and the second end of the handle threadedly engage each other. The bat includes a layer of adhesive disposed between the first end of the barrel and the second end of the handle.

A cap is disposed on the second end of the barrel with the ring coaxially disposed within the cap such that the ring and sleeve contain vibrations within the barrel.

The process for assembling a multi-component baseball bat includes disposing a rigid sleeve coaxially over a portion of an elongate composite handle, the rigid sleeve encircling a second end of the handle and extending toward a first end of the handle. A ring is positioned near the second end of the bat barrel. As part of the process, a first end of a bat barrel is inserted into the second end of the handle; the first end of the bat barrel being secured within the second end of the handle.

A section of the barrel is enveloped within the second end of the handle. Disposing the rigid sleeve over the handle includes having formed the rigid sleeve and then molding the handle with the sleeve. The sleeve is received within an annular recess in the handle.

Securing the barrel and handle together adhering the barrel to the handle. In addition, the barrel can be adhered to the sleeve. Securing the barrel and handle together can also be accomplished by threadedly engaging the first end of the barrel and the second end of the handle to define an intermediate tapered section.

A continuous tapered exterior surface of the baseball bat is formed by engagement of the barrel, handle and sleeve.

A grip can be attached to the handle and a cap disposed over an open second end of the bat barrel.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figures 1, 2:
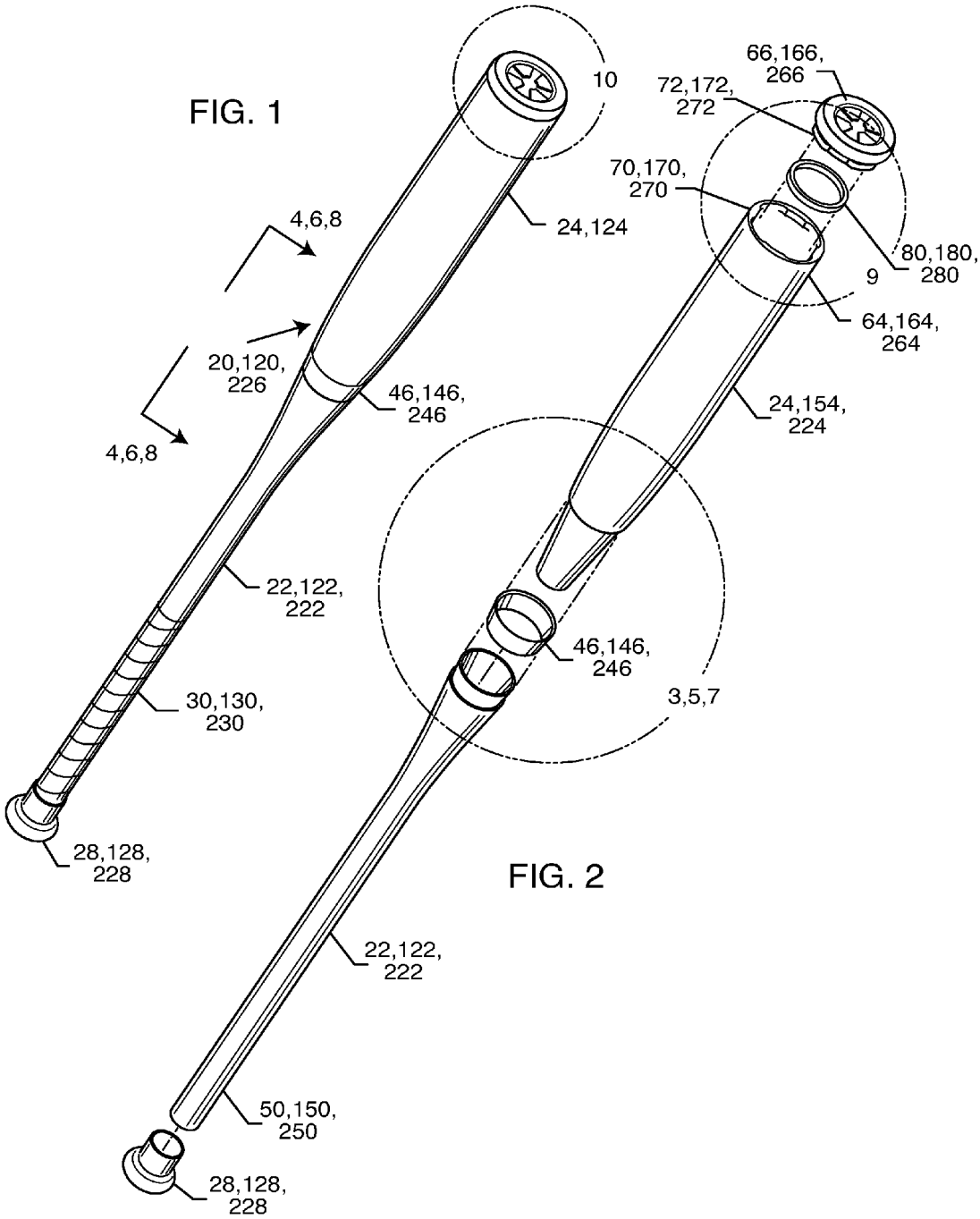
FIG. 1 is a perspective view of a baseball bat embodying the present invention.
FIG. 2 is an exploded perspective view of a bat barrel, bat handle, and interconnecting mechanism of the baseball bat of FIG. 1.
Figure 3:
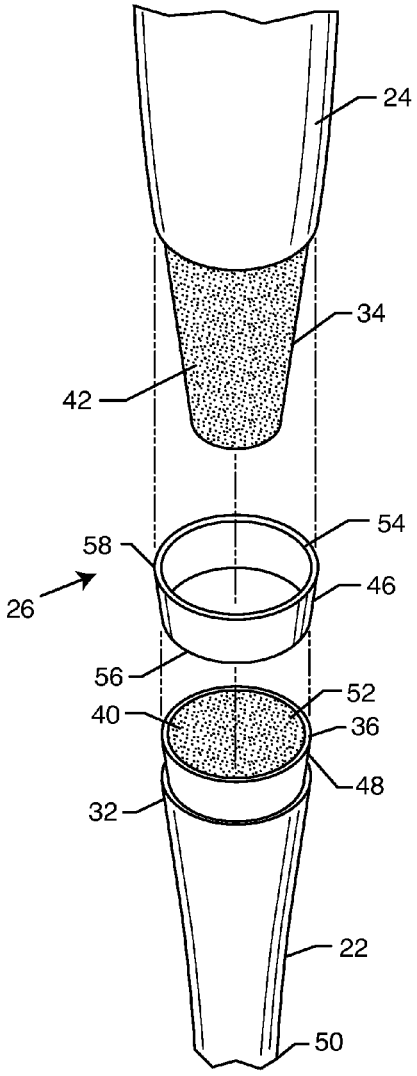
FIG. 3 is an enlarged view of area 3 of an embodiment of the bat of FIG. 2.
Figure 4:
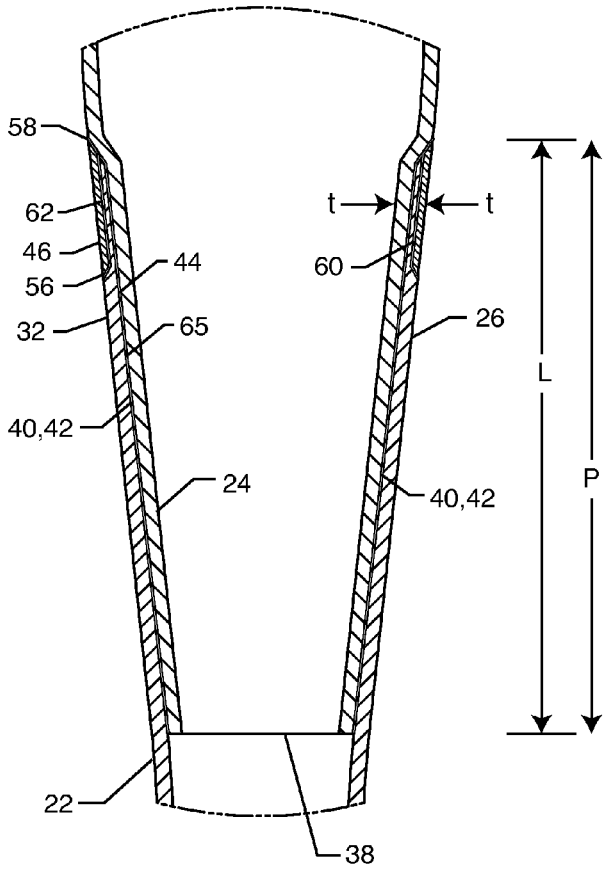
FIG. 4 is cross-sectional view taken generally along the line 4-4 of FIG. 1.
Figure 5:
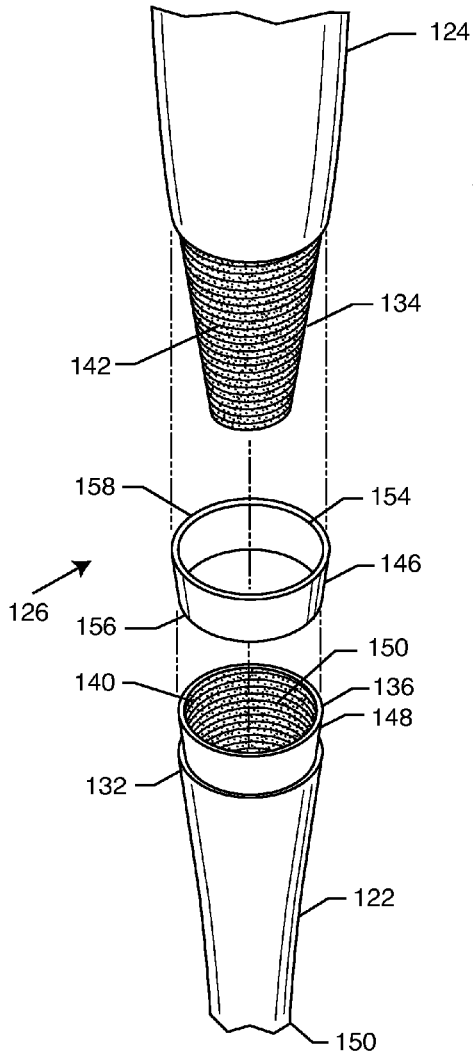
FIG. 5 is an enlarged view of area 5 of another embodiment of the bat of FIG. 2.
Figure 6:
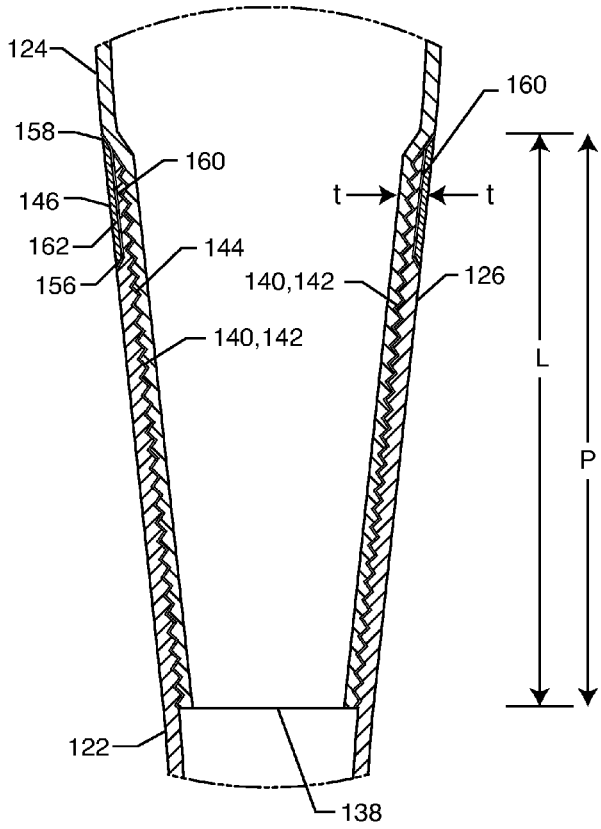
FIG. 6 is cross-sectional view taken generally along the line 6-6 of FIG. 1.
Figure 7:
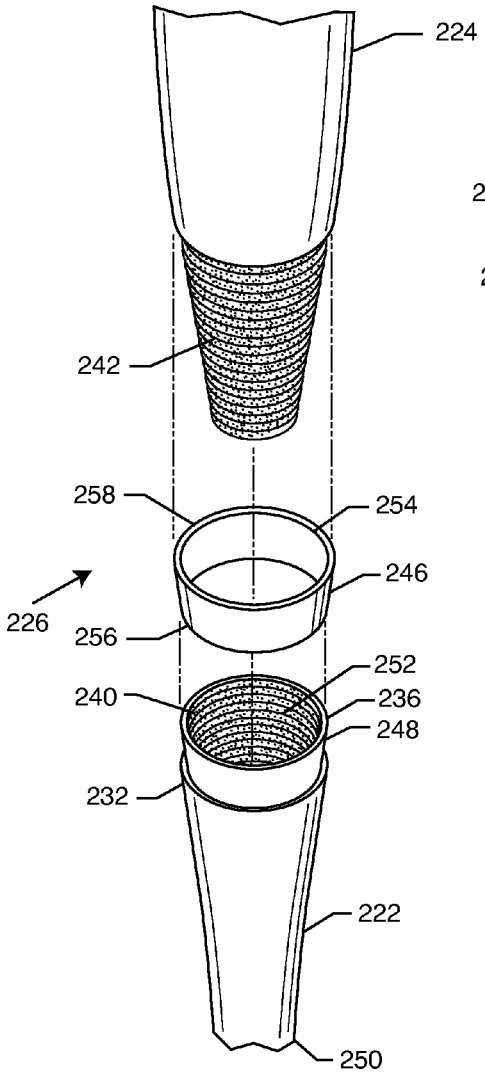
FIG. 7 is an enlarged view of area 7 of yet another embodiment of the bat of FIG. 2.
Figure 8:
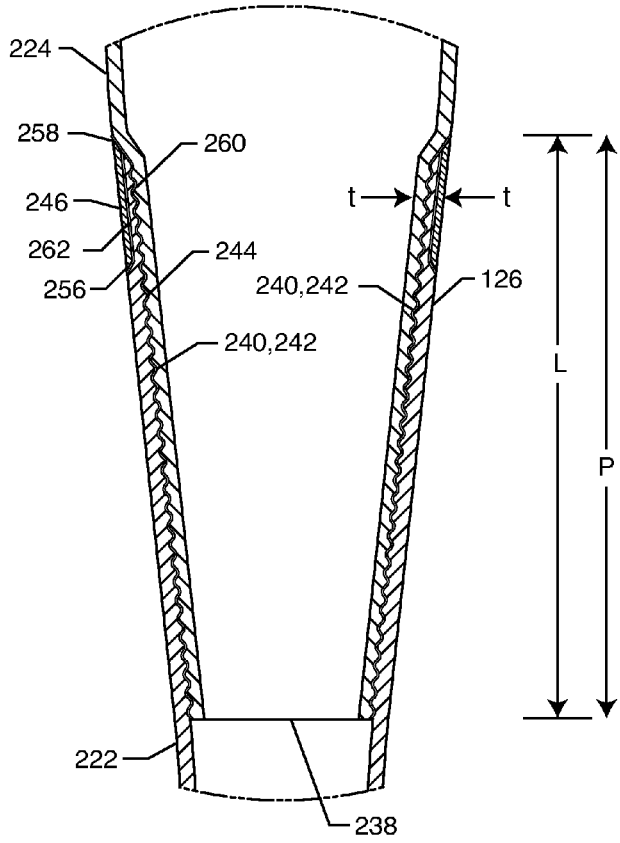
FIG. 8 is cross-sectional view taken generally along the line 8-8 of FIG. 1.
Figure 9:
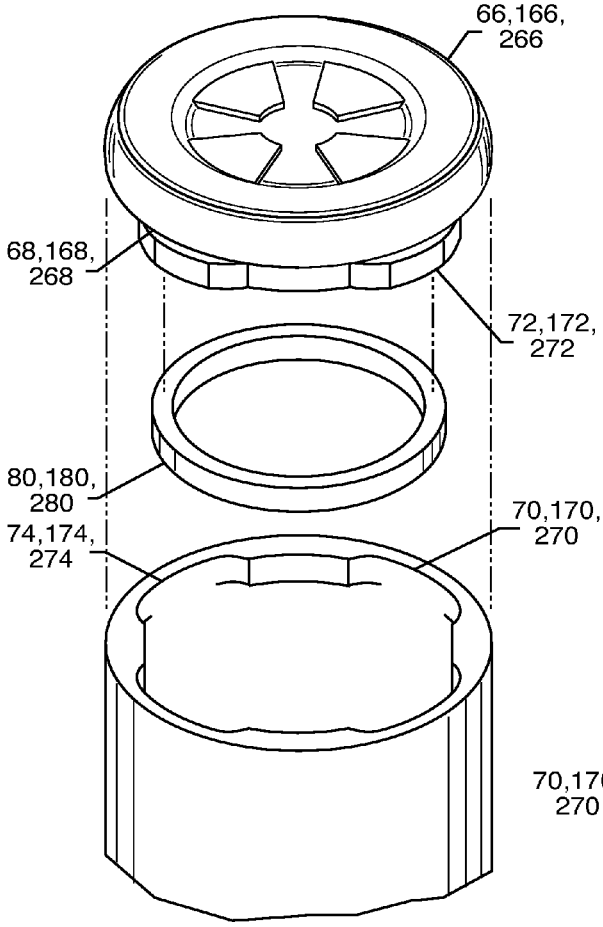
FIG. 9 is an enlarged view of area 9 of the bat of FIG. 2 illustrating attachment of an end plug to the bat barrel.
Figure 10:
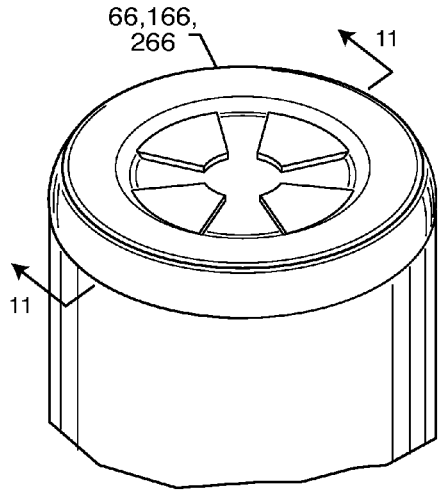
FIG. 10 is an enlarged view of area 10 of the bat of FIG. 1 illustrating the end plug on the bat barrel.
Figure 11:
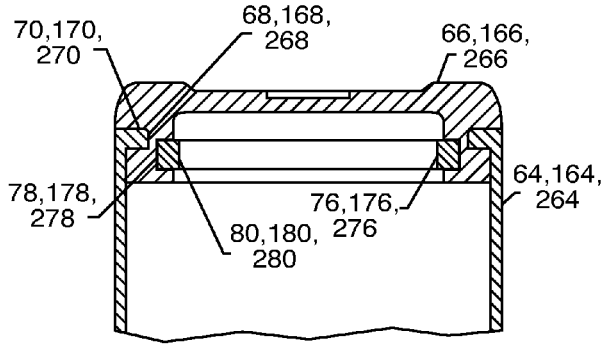
FIG. 11 is a cross-sectional view taken generally along the line 11-11 of FIG. 10.

As shown in FIGS. 1-11 for purposes of illustration, the present invention is concerned with a multi-component bat 20, 70, 120 for use in baseball or softball.

In one embodiment of the present invention, as seen in FIGS. 1-4, and 9-11, the multi-component bat 20 has an elongate hollow handle shell portion 22, an elongate hollow barrel shell portion 24 and an intermediate cylindrically tapered section 26 interconnecting the handle portion 22 and the barrel portion 24. A knob 28 is securely attached to an end of the handle portion 22 by a variety of means including, without limitation, bonding agents, glues, adhesives or the like. The knob 28 may be made of various materials including, without limitation, aluminum, magnesium, polyurethane, polycarbonate, a composite material, Zytel, Delrin, plastic or the like. Also, the handle portion 22 is typically wrapped with a grip 30 comprised of rubber, polyurethane, leather or the like, for comfort. The construction of the intermediate tapered section 26 dampens vibrations created when a ball contacts the bat 20 and provides limited pivotal movement of the barrel portion 24 relative to the handle portion 22 (i.e., a flex measured in microns).

The handle and barrel portions 22, 24 may be made of various materials including, without limitation, wood, a lightweight yet durable metal (e.g., aluminum, titanium, magnesium, or an alloy thereof), a composite material (e.g., fiberglass, carbon fibers, or a combination of glass and carbon fibers (e.g., 50/50 glass to carbon, 80/20 glass to carbon for a very flexible bat, 20/80 glass to carbon for a very stiff bat or any other ratio of glass to fiber in order to obtain a desired flex in the bat 20)) or the like. Each of the portions 22, 24 may be made of the same material or they may be made of different materials. Preferably, the handle portion 22 is comprised of a composite material and the barrel portion 24 is comprised of a 6000 or 7000 series aluminum alloy in which zinc is the major alloying element coupled with a smaller percentage of magnesium, resulting in a heat-treatable alloy of very high strength. The barrel portion 24 is finished to a mechanical strength of T6/T7 Temper. In the alternative, the handle and barrel portions 22, 24 may both be made of composite materials (of equal or differing hardness) or metal (of equal of differing hardness). In another alternative, the barrel portion 24 may be made of a composite material, such as those described above, and the handle portion 22 made of a metal, such as those described above.

The handle and barrel portions 22, 24 each include a tapered first end 32, 34 having an aperture 36, 38. The intermediate tapered section 26 of the bat 20 is defined, at least in part, when an interior surface of the tapered first end 32 of the handle portion 22 includes an adhesive layer 40 that engages an adhesive layer 42 on an exterior surface of the tapered first end 34 of the barrel portion 24. A section of the handle portion 22 envelopes the end 34 of the barrel portion 24 with the adhesive layers 40, 42 disposed between the first end 34 of the barrel portion 24 and the first end 32 of the handle portion 22. Preferably, the length of the adhesive section takes up approximately 10%-75% of the length of the tapered section 26. The adhesive engagement of the handle and barrel portions 22, 24 coaxially interconnects the handle and barrel portions 22, 24, in an aligned relation in order to provide impact absorption and reduce stress on an interface section 44 of the handle and barrel portions 22, 24 which forms a portion of the intermediate tapered section 26 of the bat 20.

The stress on the interface section 44 results from repeated impacts of a ball on the bat 20. The intermediate tapered section 26 deflects vibrations traveling from the barrel portion 24 to the handle portion 22; deflecting the energy of the vibrations back into the barrel portion 24. The deflected energy is transmitted, at least in part, back to the ball.

The intermediate section 26 includes a rigid cylindrically tapered ring or sleeve 46 attached to the first end 32 of the handle portion 22. The sleeve 46 comprises, at least in part, the intermediate tapered section 26 between the barrel and handle portions 24, 22. The sleeve 46, in the form of a hollow, exteriorly tapered sleeve, is coaxially disposed around an exterior of the first end 32 of the handle portion 22. The sleeve 46 is coaxially disposed between the barrel portion 24 and the handle portion 22 for interconnecting the barrel and handle portions 24, 22 in an aligned relation, to return energy and power to the barrel portion 24 that emanates from the barrel portion 24 due to an impact of a ball (not shown) on the barrel portion 24.

The handle portion 22 includes a cylindrical guide 48 in the handle portion 22 for receiving the sleeve 46 thereabout. The guide 48 extends a distance longitudinally from the first end 32 of the handle portion 22 towards a second, opposite end 50 of the handle portion 22 where the knob 28 is located. The aperture 36 of the first end 32 of the handle portion 22 is the entrance to an interior portion 52 of the guide 48 that extends into the handle portion 22. The sleeve 46 includes a central bore 54 having first and second tapered ends 56, 58. The cylindrical interior diameter of the bore 54 of the sleeve 46 closely matches the cylindrical exterior diameter of the tapered guide 48 in order to provide tight engagement of the sleeve 46 and guide 48. The sleeve 46 is also adhered about the guide 48 by a conventional adhesive, glue or bonding agent 60. When the handle portion 22 engages the barrel portion 24, the glue or bonding agent 60 also adheres the sleeve 46 to the exterior of the barrel portion 24. The guide 48 and the tapered first end 34 of the barrel portion 24 each define, in part, an annular recess 62 of the intermediate section 26 of the bat 20. The first and second tapered ends 56, 58 of the sleeve 46 engage tapered ends of the recess 62 such that a continuous exterior surface of the bat 20 is formed. When the handle portion 22 engages the barrel portion 24, a portion of the end 32 of the handle portion 22 is disposed between the sleeve 46 and the barrel portion 24.

The engagement of the barrel portion 24, the handle portion 22 and the sleeve 46 provides a generally continuous exterior surface of the baseball bat 20. This is, at least partially, because the angle of the tapered exterior surface of the sleeve 46 matches the angles of the tapered first ends 32, 34 of the handle and barrel portions 22, 24; the angle of the first tapered ends 32, 34 being between zero and forty-five degrees.

The sleeve 46 is comprised of polyurethane, or polycarbonate, a composite material (e.g., fiberglass, carbon fibers, or a combination of glass and carbon fibers), metal (e.g., aluminum, titanium, magnesium, or an alloy thereof), or an elastomeric material (e.g., solid rubber, high performance rubber foam, silicone or similar materials). The sleeve 46 can be made of transparent material (colored or non-colored) or an opaque material (colored or non-colored). The sleeve 46 may be solid or partially hollowed out to decrease its weight.

The bat 20 may be assembled in a number of ways. In one particular way, the handle portion 22 is mated with the barrel portion 24 by adhering the sleeve 46 about the guide 48. The first end 34 of the barrel portion 24 is inserted through the aperture 36 of the open first end 32 of the handle portion 22 with the adhesive layers 40, 42 bonding the barrel portion 24 to the handle portion 22 once the barrel portion 24 engages the sleeve 46 and can travel no further into the interior portion 52 of the handle portion 22. The securement of the handle and barrel portions 22, 24, with the sleeve 46 disposed therebetween in the recess 62 formed thereby, provides a generally continuous exterior surface of the baseball bat 20 when the handle portion 22 engages the barrel portion 24.

The components of the intermediate tapered section 26 tightly fit together to isolate vibrations which insulates the handle portion 22 from vibrations generated in the barrel portion 24 when a ball strikes the barrel portion 24. The length of the intermediate tapered section 26 will be varied based on the size and type of bat (e.g., adult baseball bat, youth baseball bat, softball bat or the like). The high strength bonding agent 60 (e.g. rubberized glue, rubber cement, etc.) may be applied to all joins to secure all the connections. The bonding agent 60 helps to dampen vibrations, fill in gaps and allow additional flexibility. The flexibility of the bonding agent 60 helps to give the bat 20 a whipping effect since the two materials that form, respectively, the handle and barrel portions 22, 24 flex at different rates (the barrel portion 24 flexing more than the handle portion 22) and the bonding agent 60 provides a flexible cushion along the interface of the sleeve 46, handle portion 22 and barrel portion 24.

A second end 64 of the barrel portion 24 is typically open and directed inward for acceptance and retention of a rigid cap or end plug 66 that increases the rigidity of the bat 20. The end plug 66 is typically comprised of urethane, polyurethane, Zytel or the like. The end plug 66 has a circumferential outer groove 68 which accepts an inwardly directed annular lip 70 of the barrel portion 24. The end plug 66 is then secured to the end 64 of the barrel portion 24 by inserting a number pairs of keys 72 disposed on opposite sides of the end plug 66 into slots or keyholes 74 disposed on opposite sides of the lip 72 and rotating the end plug 66 therein. Bonding agent 60 may be used to secure the end plug 66 in position. A recess 76 is formed on a top surface of the end plug 66 in order to allow a tool having a complimentary shape to the recess 76 engage the end plug 66 in order to secure the end plug 66 within the barrel 24. The end plug 66 includes a circumferential inner groove 78 within which a rigid ring 80 is at least partially disposed. The sleeve 46 at the intermediate section 26 blocks vibrations by itself, and in combination with the ring 80 within the end plug 66, the sleeve 46 and the ring 80 interact to create a larger sweet spot along the length of the barrel 24. The sleeve 46 and the ring 80, disposed at opposite ends 34, 64 of the barrel 24, cooperate to contain vibrations that occur when a ball hits the bat 20 as well as channel those vibrations in order to increase the volume of a desirable "ping" sound that occurs from the ball hitting the bat 20. The ring 80 is made of a 65D polyurethane material that allows a softer durometer material to be used in the end plug 66.

In another embodiment of the present invention, as seen in FIGS. 1, 2, 5, 6, and 9-11, a multi-component bat 120, similar to the bat 20 described above, has an elongate hollow handle shell portion 122, an elongate hollow barrel shell portion 124 and an intermediate cylindrically tapered section 126 interconnecting the handle portion 122 and the barrel portion 124. A knob 128 is securely attached to the end of the handle portion 122 by a variety of means including, but not limited to, bonding agents, glues, adhesives or the like. The knob 128 may be made of various materials including, without limitation, aluminum, magnesium, Zytel, Delrin, plastic, polyurethane, polycarbonate, a composite material or the like. Also, the handle portion 122 is typically wrapped with a grip 130 comprised of rubber, polyurethane, leather or the like, for comfort. The construction of the intermediate tapered section 126 dampens vibrations created when a ball contacts the bat 120 and provides limited pivotal movement of the barrel portion 124 relative to the handle portion 122 (i.e., a flex measured in microns).

The handle and barrel portions 122, 124 may be made of various materials including, without limitation, wood, a lightweight yet durable metal (e.g., aluminum, titanium, magnesium, or an alloy thereof), a composite material (e.g., fiberglass, carbon fibers, or a combination of glass and carbon fibers (e.g., 50/50 glass to carbon, 80/20 glass to carbon for a very flexible bat, 20/80 glass to carbon for a very stiff bat or any other ratio of glass to fiber in order to obtain a desired flex in the bat 120)) or the like. Each of the portions 122, 124 may be made of the same material or they may be made of different materials. Preferably, the handle portion 122 is comprised of a composite material and the barrel portion 124 is comprised of a 6000 or 7000 series aluminum alloy in which zinc is the major alloying element coupled with a smaller percentage of magnesium, resulting in a heat-treatable alloy of very high strength. The barrel portion 124 is finished to a mechanical strength of T6/T7 Temper. In the alternative, the handle and barrel portions 72, 74 may both be made of composite materials (of equal or differing hardness) or metal (of equal of differing hardness). In another alternative, the barrel portion 124 may be made of a composite material, such as those described above, and the handle portion 122 made of a metal, such as those described above.

The handle and barrel portions 122, 124 each include a tapered first end 132, 134 having an aperture 136, 138. The intermediate tapered section 126 of the bat 120 is defined, at least in part, when the first end 134 of the barrel portion 124 and the first end 132 of the handle portion 122 threadedly engage each other. An interior surface of the tapered first end 132 of the handle portion 122 includes threads 140 that engage threads 142 on an exterior surface of the tapered first end 134 of the barrel portion 124. A section of the handle portion 122 envelopes the end 134 of the barrel portion 124 with the engaged threads 140, 142 disposed between the first end 134 of the barrel portion 124 and the first end 132 of the handle portion 122. Preferably, the length of the threaded section takes up approximately 10%-75% of the length of the tapered section 126. The threaded engagement of the handle and barrel portions 122, 124 coaxially interconnects the handle and barrel portions 122, 124, in an aligned relation in order to provide impact absorption and reduce stress on an interface section 144 of the handle and barrel portions 122, 124 which forms a portion of the intermediate tapered section 126 of the bat 120. The stress on the interface section 144 results from repeated impacts of a ball on the bat 120. The intermediate tapered section 126 deflects vibrations traveling from the barrel portion 124 to the handle portion 122; deflecting the energy of the vibrations back into the barrel portion 124. The deflected energy is transmitted, at least in part, back to the ball.

The intermediate section 126 includes a rigid cylindrically tapered ring or sleeve 146 attached to the first end 132 of the handle portion 122. The sleeve 146 comprises, at least in part, the intermediate tapered section 126 between the barrel and handle portions 124, 122. The sleeve 146, in the form of a hollow, exteriorly tapered sleeve, is coaxially disposed around an exterior of the first end 132 of the handle portion 122. The sleeve 146 is coaxially disposed between the barrel portion 124 and the handle portion 122 for interconnecting the barrel and handle portions 124, 122 in an aligned relation, to return energy and power to the barrel portion 124 that emanates from the barrel portion 124 due to an impact of a ball (not shown) on the barrel portion 124.

The handle portion 122 includes a cylindrical guide 148 in the handle portion 122 for receiving the sleeve 146 thereabout. The guide 148 extends a distance longitudinally from the first end 132 of the handle portion 122 towards a second, opposite end 150 of the handle portion 122 where the knob 128 is located. The aperture 136 of the first end 132 of the handle portion 122 is the entrance to an interior portion 152 of the guide 148 that extends into the handle portion 122. The sleeve 146 includes a central bore 154 having first and second tapered ends 156, 158. The cylindrical interior diameter of the bore 154 of the sleeve 146 closely matches the cylindrical exterior diameter of the tapered guide 148 in order to provide tight engagement of the sleeve 146 and guide 148. The sleeve 146 is also adhered about the guide 148 by a conventional adhesive, glue or bonding agent 160. When the handle portion 122 engages the barrel portion 124, the glue or bonding agent 160 also adheres the sleeve 146 to the exterior of the barrel portion 124. The guide 148 and the tapered first end 134 of the barrel portion 124 each define, in part, an annular recess 162 of the intermediate section 126 of the bat 120. The first and second tapered ends 156, 158 of the sleeve 146 engage tapered ends of the recess 162 such that a continuous exterior surface of the bat 120 is formed. When the handle portion 122 engages the barrel portion 124, a portion of the end 132 of the handle portion 122 is disposed between the sleeve 146 and the barrel portion 124.

The engagement of the barrel portion 124, the handle portion 122 and the sleeve 146 provides a generally continuous exterior surface of the baseball bat 120. This is, at least partially, because the angle of the tapered exterior surface of the sleeve 146 matches the angles of the tapered first ends 132, 134 of the handle and barrel portions 122, 124; the angle of the first tapered ends 132, 134 being between zero and forty-five degrees.

The sleeve 146 is comprised of polyurethane, or polycarbonate, a composite material (e.g., fiberglass, carbon fibers, or a combination of glass and carbon fibers), metal (e.g., aluminum, titanium, magnesium, or an alloy thereof), or an elastomeric material (e.g., solid rubber, high performance rubber foam, silicone or similar materials). The sleeve 146 can be made of transparent material (colored or non-colored) or an opaque material (colored or non-colored). The sleeve 146 may be solid or partially hollowed out to decrease its weight.

The bat 120 may be assembled in a number of ways. In one particular way, the handle portion 122 is mated with the barrel portion 124 by adhering the sleeve 146 about the guide 148. The first end 134 of the barrel portion 124 is inserted through the aperture 136 of the open first end 132 of the handle portion 122 with the threads 140, 142 engaging the barrel portion 124 to the handle portion 122 until the barrel portion 124 can travel no further into the interior portion 152 of the handle portion 122. The securement of the handle and barrel portions 122, 124, with the sleeve 146 disposed therebetween in the recess 162 formed thereby, provides a generally continuous exterior surface of the baseball bat 120 when the handle portion 122 engages the barrel portion 124.

The components of the intermediate tapered section 126 tightly fit together to isolate vibrations which insulates the handle portion 122 from vibrations generated in the barrel portion 124 when a ball strikes the barrel portion 124. The length of the intermediate tapered section 126 will be varied based on the size and type of bat (e.g., adult baseball bat, youth baseball bat, softball bat or the like). The high strength bonding agent 160 (e.g. rubberized glue, rubber cement, etc.) may be applied to all joins to secure all the connections. The bonding agent 160 helps to dampen vibrations, fill in gaps and allow additional flexibility. The flexibility of the bonding agent 160 helps to give the bat 120 a whipping effect since the two materials that form, respectively, the handle and barrel portions 122, 124 flex at different rates (the barrel portion 124 flexing more than the handle portion 122) and the bonding agent 160 provides a flexible cushion along the interface of the sleeve 146, handle portion 122 and barrel portion 124.

A second end 164 of the barrel portion 124 is typically open and directed inward for acceptance and retention of a rigid cap or end plug 166 that increases the rigidity of the bat 120. The end plug 166 is typically comprised of urethane, polyurethane, Zytel or the like. The end plug 166 has a circumferential outer groove 168 which accepts an inwardly directed annular lip 170 of the barrel portion 124. The end plug 166 is then secured to the end 164 of the barrel portion 124 by inserting a number pairs of keys 172 disposed on opposite sides of the end plug 166 into slots or keyholes 174 disposed on opposite sides of the lip 172 and rotating the end plug 166 therein. Bonding agent 160 may be used to secure the end plug 166 in position. A recess 176 is formed on a top surface of the end plug 166 in order to allow a tool having a complimentary shape to the recess 176 engage the end plug 166 in order to secure the end plug 166 within the barrel 124. The end plug 166 includes a circumferential inner groove 178 within which a rigid ring 180 is at least partially disposed. The sleeve 146 at the intermediate section 126 blocks vibrations by itself, and in combination with the ring 180 within the end plug 166, the sleeve 146 and the ring 180 interact to create a larger sweet spot along the length of the barrel 124. The sleeve 126 and the ring 180, disposed at opposite ends 134, 164 of the barrel 124, cooperate to contain vibrations that occur when a ball hits the bat 120 as well as channel those vibrations in order to increase the volume of a desirable "ping" sound that occurs from the ball hitting the bat 120. The ring 180 is made of a 65D polyurethane material that allows a softer durometer material to be used in the end plug 166.

In another embodiment of the present invention, as seen in FIGS. 1, 2 and 7-11, the multi-component bat 220, similar to the bat 20, 120 described above, has an elongate hollow handle shell portion 222, an elongate hollow barrel shell portion 224 and an intermediate cylindrically tapered section 226 interconnecting the handle portion 222 and the barrel portion 224. A knob 228 is securely attached to the end of the handle portion 222 by a variety of means including, but not limited to, bonding agents, glues, adhesives or the like. The knob 228 may be made of various materials including, without limitation, aluminum, magnesium, Zytel, Delrin, plastic, polyurethane, polycarbonate, a composite material or the like. Also, the handle portion 222 is typically wrapped with a grip 230 comprised of rubber, polyurethane, leather or the like, for comfort. The construction of the intermediate tapered section 226 dampens vibrations created when a ball contacts the bat 220 and provides limited pivotal movement of the barrel portion 224 relative to the handle portion 222 (i.e., a flex measured in microns).

The handle and barrel portions 222, 224 may be made of various materials including, without limitation, wood, a lightweight yet durable metal (e.g., aluminum, titanium, magnesium, or an alloy thereof), a composite material (e.g., fiberglass, carbon fibers, or a combination of glass and carbon fibers (e.g., 50/50 glass to carbon, 80/20 glass to carbon for a very flexible bat, 20/80 glass to carbon for a very stiff bat or any other ratio of glass to fiber in order to obtain a desired flex in the bat 220)) or the like. Each of the portions 222, 224 may be made of the same material or they may be made of different materials. Preferably, the handle portion 222 is comprised of a composite material and the barrel portion 224 is comprised of a 6000 or 7000 series aluminum alloy in which zinc is the major alloying element coupled with a smaller percentage of magnesium, resulting in a heat-treatable alloy of very high strength. The barrel portion 224 is finished to a mechanical strength of T6/T7 Temper. In the alternative, the handle and barrel portions 222, 224 may both be made of composite materials (of equal or differing hardness) or metal (of equal of differing hardness). In another alternative, the barrel portion 224 may be made of a composite material, such as those described above, and the handle portion 222 made of a metal, such as those described above.

The handle and barrel portions 222, 224 each include a tapered first end 232, 234 having an aperture 236, 238. The intermediate tapered section 226 of the bat 220 is defined, at least in part, when the first end 234 of the barrel portion 224 and the first end 232 of the handle portion 212 engage each other. An interior surface of the tapered first end 232 of the handle portion 222 includes corrugations 240 that engage corrugations 242 on an exterior surface of the tapered first end 234 of the barrel portion 224. The corrugations 240, 242 absorb and block vibrations from traveling from the barrel to the handle. A section of the handle portion 222 envelopes the end 234 of the barrel portion 224 with the engaged corrugations 240, 242 disposed between the first end 234 of the barrel portion 224 and the first end 232 of the handle portion 222. Preferably, the length of the threaded section takes up approximately 10%-75% of the length of the tapered section 226. The engagement of the respective corrugations 140, 142 of the handle and barrel portions 222, 224 coaxially interconnects the handle and barrel portions 222, 224, in an aligned relation in order to provide impact absorption and reduce stress on an interface section 244 of the handle and barrel portions 222, 224 which forms a portion of the intermediate tapered section 226 of the bat 220. The stress on the interface section 244 results from repeated impacts of a ball on the bat 220. The intermediate tapered section 226 deflects vibrations traveling from the barrel portion 224 to the handle portion 222; deflecting the energy of the vibrations back into the barrel portion 224. The deflected energy is transmitted, at least in part, back to the ball.

The intermediate section 226 includes a rigid cylindrically tapered ring or sleeve 246 attached to the first end 232 of the handle portion 222. The sleeve 246 comprises, at least in part, the intermediate tapered section 226 between the barrel and handle portions 224, 222. The sleeve 246, in the form of a hollow, exteriorly tapered sleeve, is coaxially disposed around an exterior of the first end 232 of the handle portion 222. The sleeve 246 is coaxially disposed between the barrel portion 224 and the handle portion 222 for interconnecting the barrel and handle portions 224, 222 in an aligned relation, to return energy and power to the barrel portion 224 that emanates from the barrel portion 224 due to an impact of a ball (not shown) on the barrel portion 224.

The handle portion 222 includes a cylindrical guide 248 in the handle portion 222 for receiving the sleeve 246 thereabout. The guide 248 extends a distance longitudinally from the first end 232 of the handle portion 222 towards a second, opposite end 250 of the handle portion 222 where the knob 228 is located. The aperture 236 of the first end 232 of the handle portion 222 is the entrance to an interior portion 252 of the guide 238 that extends into the handle portion 222. The sleeve 246 includes a central bore 254 having first and second tapered ends 256, 258. The cylindrical interior diameter of the bore 254 of the sleeve 246 closely matches the cylindrical exterior diameter of the tapered guide 248 in order to provide tight engagement of the sleeve 246 and guide 248. The sleeve 246 is also adhered about the guide 248 by a conventional adhesive, glue or bonding agent 260. When the handle portion 222 engages the barrel portion 224, the glue or bonding agent 260 also adheres the sleeve 246 to the exterior of the barrel portion 224. The guide 248 and the tapered first end 234 of the barrel portion 224 each define, in part, an annular recess 262 of the intermediate section 226 of the bat 220. The first and second tapered ends 256, 258 of the sleeve 246 engage tapered ends of the recess 262 such that a continuous exterior surface of the bat 220 is formed. When the handle portion 222 engages the barrel portion 224, a portion of the end 232 of the handle portion 222 is disposed between the sleeve 246 and the barrel portion 224.

The engagement of the barrel portion 224, the handle portion 222 and the sleeve 246 provides a generally continuous exterior surface of the baseball bat 220. This is, at least partially, because the angle of the tapered exterior surface of the sleeve 246 matches the angles of the tapered first ends 232, 234 of the handle and barrel portions 222, 224; the angle of the first tapered ends 232, 234 being between zero and forty-five degrees.

The sleeve 246 is comprised of polyurethane, or polycarbonate, a composite material (e.g., fiberglass, carbon fibers, or a combination of glass and carbon fibers), metal (e.g., aluminum, titanium, magnesium, or an alloy thereof), or an elastomeric material (e.g., solid rubber, high performance rubber foam, silicone or similar materials). The sleeve 246 can be made of transparent material (colored or non-colored) or an opaque material (colored or non-colored). The sleeve 246 may be solid or partially hollowed out to decrease its weight.

The bat 220 may be assembled in a number of ways. In one particular way, the handle portion 222 is mated with the barrel portion 224 by adhering the sleeve 246 about the guide 248. The first end 234 of the barrel portion 224 is inserted through the aperture 236 of the open first end 232 of the handle portion 222 with the corrugations 240, 242 engaging the barrel portion 224 to the handle portion 222 until the barrel portion 224 can travel no further into the interior portion 252 of the handle portion 222. The securement of the handle and barrel portions 222, 224, with the sleeve 246 disposed therebetween in the recess 262 formed thereby, provides a generally continuous exterior surface of the baseball bat 220 when the handle portion 222 engages the barrel portion 224.

The components of the intermediate tapered section 226 tightly fit together to isolate vibrations which insulates the handle portion 222 from vibrations generated in the barrel portion 224 when a ball strikes the barrel portion 224. The length of the intermediate tapered section 226 will be varied based on the size and type of bat (e.g., adult baseball bat, youth baseball bat, softball bat or the like). The high strength bonding agent 260 (e.g. rubberized glue, rubber cement, etc.) may be applied to all joins to secure all the connections. The bonding agent 260 helps to dampen vibrations, fill in gaps and allow additional flexibility. The flexibility of the bonding agent 260 helps to give the bat 220 a whipping effect since the two materials that form, respectively, the handle and barrel portions 222, 224 flex at different rates (the barrel portion 224 flexing more than the handle portion 222) and the bonding agent 260 provides a flexible cushion along the interface of the sleeve 246, handle portion 222 and barrel portion 224.

A second end 264 of the barrel portion 224 is typically open and directed inward for acceptance and retention of a rigid cap or end plug 266 that increases the rigidity of the bat 220. The end plug 266 is typically comprised of urethane, polyurethane, Zytel or the like. The end plug 266 has a circumferential outer groove 268 which accepts an inwardly directed annular lip 270 of the barrel portion 224. The end plug 266 is then secured to the end 264 of the barrel portion 224 by inserting a number pairs of keys 272 disposed on opposite sides of the end plug 266 into slots or keyholes 274 disposed on opposite sides of the lip 272 and rotating the end plug 266 therein. Bonding agent 260 may be used to secure the end plug 266 in position. A recess 276 is formed on a top surface of the end plug 266 in order to allow a tool having a complimentary shape to the recess 276 engage the end plug 266 in order to secure the end plug 266 within the barrel 224. The end plug 266 includes a circumferential inner groove 278 within which a rigid ring 280 is at least partially disposed. The sleeve 246 at the intermediate section 226 blocks vibrations by itself, and in combination with the ring 280 within the end plug 266, the sleeve 246 and the ring 280 interact to create a larger sweet spot along the length of the barrel 224. The sleeve 226 and the ring 280, disposed at opposite ends 234, 264 of the barrel 224, cooperate to contain vibrations that occur when a ball hits the bat 220 as well as channel those vibrations in order to increase the volume of a desirable "ping" sound that occurs from the ball hitting the bat 220. The ring 280 is made of a 65D polyurethane material that allows a softer durometer material to be used in the end plug 266.

Figures 12, 13:
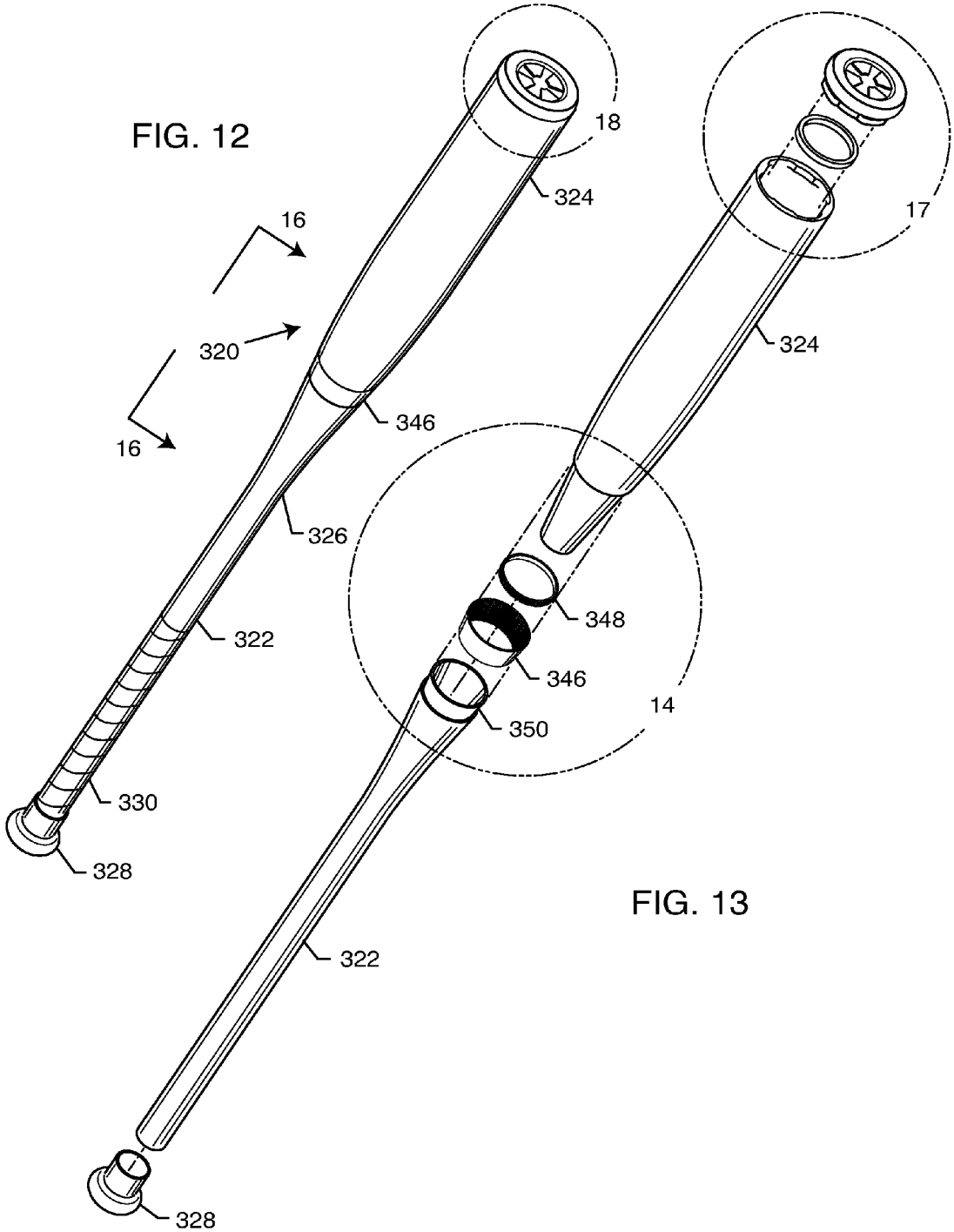
FIG. 12 is a perspective view of still another baseball bat embodying the present invention.
FIG. 13 is an exploded perspective view of a bat barrel, bat handle, and interconnecting mechanism of the baseball bat of FIG. 12.
Figure 14:
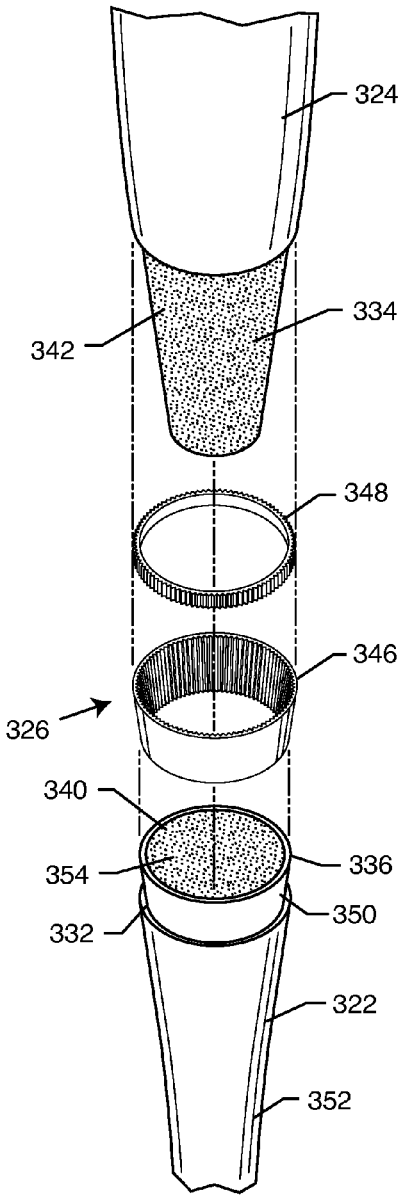
FIG. 14 is an enlarged view of area 14 of the bat of FIG. 13.
Figure 15:
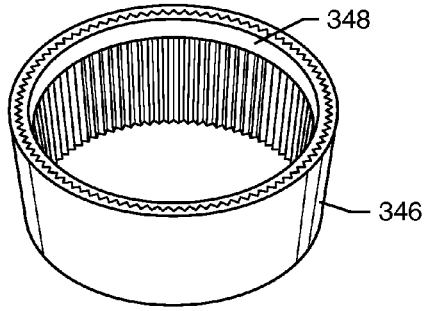
FIG. 15 is a top perspective view of a fluted ring used with the bat of FIG. 12.
Figure 16:
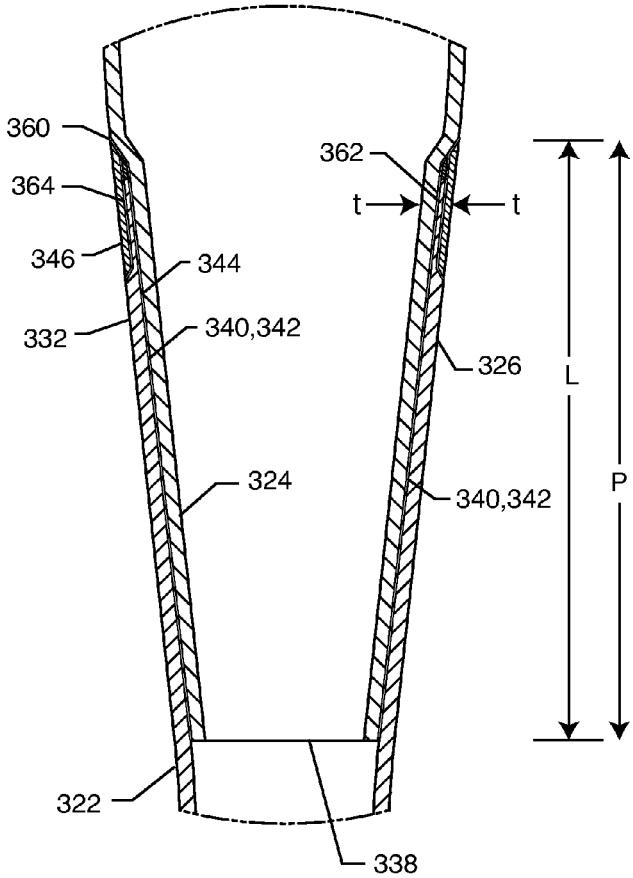
FIG. 16 is cross-sectional view taken generally along the line 16-16 of FIG. 12.
Figure 17:
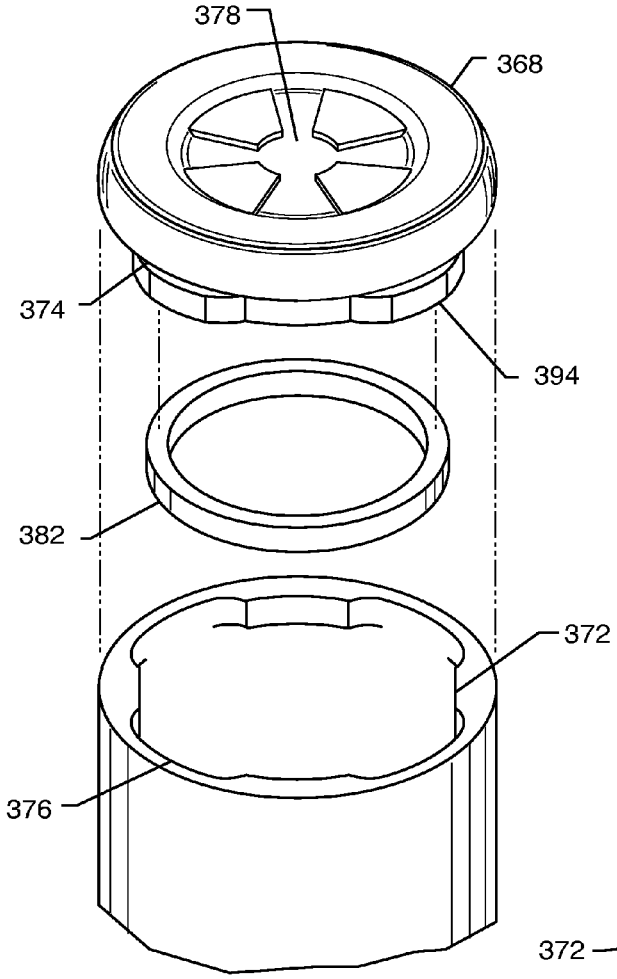
FIG. 17 is an enlarged view of area 17 of the bat of FIG. 13 illustrating attachment of an end plug to the bat barrel.
Figure 18:
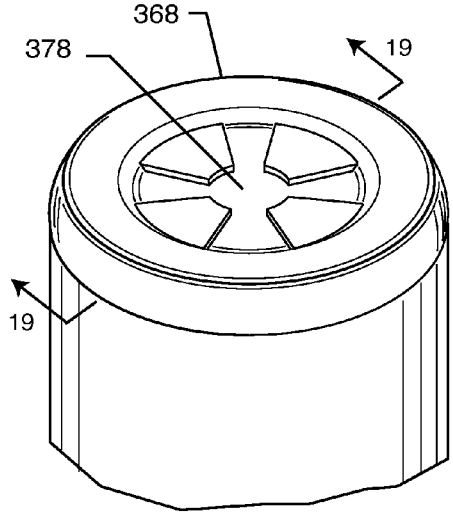
FIG. 18 is an enlarged view of area 18 of the bat of FIG. 12 illustrating the end plug on the bat barrel.
Figure 19:
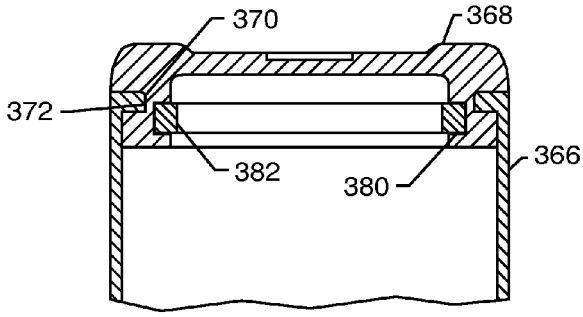
FIG. 19 is a cross-sectional view taken generally along the line 19-19 of FIG. 12.

In still another embodiment of the present invention, as seen in FIGS. 12-19, a multi-component bat 320, similar to the bat 20, 120, 220 described above, has an elongate hollow handle shell portion 322, an elongate hollow barrel shell portion 324 and an intermediate cylindrically tapered section 326 interconnecting the handle portion 322 and the barrel portion 324. A knob 328 is securely attached to an end of the handle portion 322 by a variety of means including, without limitation, bonding agents, glues, adhesives or the like. The knob 328 may be made of various materials including, without limitation, aluminum, magnesium, polyurethane, polycarbonate, a composite material, Zytel, Delrin, plastic or the like. Also, the handle portion 322 is typically wrapped with a grip 330 comprised of rubber, polyurethane, leather or the like, for comfort. The construction of the intermediate tapered section 326 dampens vibrations created when a ball contacts the bat 320 and provides limited pivotal movement of the barrel portion 324 relative to the handle portion 322 (i.e., a flex measured in microns).

The handle and barrel portions 322, 324 may be made of various materials including, without limitation, wood, a lightweight yet durable metal (e.g., aluminum, titanium, magnesium, or an alloy thereof), a composite material (e.g., fiberglass, carbon fibers, or a combination of glass and carbon fibers (e.g., 50/50 glass to carbon, 80/20 glass to carbon for a very flexible bat, 20/80 glass to carbon for a very stiff bat or any other ratio of glass to fiber in order to obtain a desired flex in the bat 320)) or the like. Each of the portions 322, 324 may be made of the same material or they may be made of different materials. Preferably, the handle portion 322 is comprised of a composite material and the barrel portion 324 is comprised of a 6000 or 7000 series aluminum alloy in which zinc is the major alloying element coupled with a smaller percentage of magnesium, resulting in a heat-treatable alloy of very high strength. The barrel portion 324 is finished to a mechanical strength of T6/T7 Temper. In the alternative, the handle and barrel portions 322, 324 may both be made of composite materials (of equal or differing hardness) or metal (of equal of differing hardness). In another alternative, the barrel portion 324 may be made of a composite material, such as those described above, and the handle portion 322 made of a metal, such as those described above.

The handle and barrel portions 322, 324 each include a tapered first end 332, 334 having an aperture 336, 338. The intermediate tapered section 326 of the bat 320 is defined, at least in part, when an interior surface of the tapered first end 332 of the handle portion 322 includes an adhesive layer 340 that engages an adhesive layer 342 on an exterior surface of the tapered first end 334 of the barrel portion 324. A section of the handle portion 322 envelopes the end 334 of the barrel portion 324 with the adhesive layers 340, 342 disposed between the first end 334 of the barrel portion 324 and the first end 332 of the handle portion 322. Preferably, the length of the adhesive section takes up approximately 10%-75% of the length of the tapered section 326. The adhesive engagement of the handle and barrel portions 322, 324 coaxially interconnects the handle and barrel portions 322, 324, in an aligned relation in order to provide impact absorption and reduce stress on an interface section 344 of the handle and barrel portions 322, 324 which forms a portion of the intermediate tapered section 326 of the bat 320.

The stress on the interface section 344 results from repeated impacts of a ball on the bat 320. The intermediate tapered section 326 deflects vibrations traveling from the barrel portion 324 to the handle portion 322; deflecting the energy of the vibrations back into the barrel portion 324. The deflected energy is transmitted, at least in part, back to the ball.

The intermediate section 326 includes a rigid cylindrically tapered ring or sleeve 346 attached to the first end 332 of the handle portion 322. The sleeve 346 comprises, at least in part, the intermediate tapered section 26 between the barrel and handle portions 324, 322. The sleeve 346, in the form of a hollow, exteriorly tapered sleeve having a fluted interior surface, is coaxially disposed around an exterior of the first end 332 of the handle portion 322. A rubber or silicone ring 348, disposed partially within the sleeve 346, includes an exterior fluted surface that engages the interior fluted surface of the sleeve 346. The sleeve 346 and ring 348 are coaxially disposed between the barrel portion 324 and the handle portion 322 for interconnecting the barrel and handle portions 324, 322 in an aligned relation, to return energy and power to the barrel portion 324 that emanates from the barrel portion 324 due to an impact of a ball (not shown) on the barrel portion 324.

The handle portion 322 includes a cylindrical guide 350 in the handle portion 322 for receiving the sleeve 346 and ring 348 thereabout. The guide 350 extends a distance longitudinally from the first end 332 of the handle portion 322 towards a second, opposite end 352 of the handle portion 322 where the knob 328 is located. The aperture 336 of the first end 332 of the handle portion 322 is the entrance to an interior portion 354 of the guide 350 that extends into the handle portion 322. The sleeve 346 includes a central bore 356 having first and second tapered ends 358, 360. The ring 348 is disposed near the second end 360. The cylindrical interior diameter of the bore 356 of the sleeve 346 and the interior diameter of the ring 348 closely matches the cylindrical exterior diameter of the tapered guide 350 in order to provide tight engagement of the sleeve 346, ring 348 and guide 350. The sleeve 346 and ring 348 are also adhered about the guide 350 by a conventional adhesive, glue or bonding agent 362. When the handle portion 322 engages the barrel portion 324, the glue or bonding agent 362 also adheres the sleeve 346 and the ring 348 to the exterior of the barrel portion 324. The guide 350 and the tapered first end 334 of the barrel portion 324 each define, in part, an annular recess 364 of the intermediate section 326 of the bat 320. The first and second tapered ends 358, 360 of the sleeve 346 engage tapered ends of the recess 364 such that a continuous exterior surface of the bat 320 is formed. When the handle portion 322 engages the barrel portion 324, a portion of the end 332 of the handle portion 322 is disposed between the sleeve 346, the ring 348 and the barrel portion 324.

The engagement of the barrel portion 324, the handle portion 322 and the sleeve 346 provides a generally continuous exterior surface of the baseball bat 320. This is, at least partially, because the angle of the tapered exterior surface of the sleeve 346 matches the angles of the tapered first ends 332, 334 of the handle and barrel portions 322, 324; the angle of the first tapered ends 332, 334 being between zero and forty-five degrees.

The sleeve 346 is comprised of polyurethane, or polycarbonate, a composite material (e.g., fiberglass, carbon fibers, or a combination of glass and carbon fibers), metal (e.g., aluminum, titanium, magnesium, or an alloy thereof), or an elastomeric material (e.g., solid rubber, high performance rubber foam, silicone or similar materials). The sleeve 346 can be made of transparent material (colored or non-colored) or an opaque material (colored or non-colored). The sleeve 346 may be solid or partially hollowed out to decrease its weight.

The bat 320 may be assembled in a number of ways. In one particular way, the handle portion 322 is mated with the barrel portion 324 by adhering the sleeve 346 and the ring 348 about the guide 350. The ring 348 may also be adhered to the sleeve 346. The first end 334 of the barrel portion 324 is inserted through the aperture 336 of the open first end 332 of the handle portion 322 with the adhesive layers 340, 342 bonding the barrel portion 324 to the handle portion 322 once the barrel portion 324 engages the sleeve 346 and ring 350 and can travel no further into the interior portion 354 of the handle portion 322. The securement of the handle and barrel portions 322, 324, with the sleeve 346 and ring 348 disposed therebetween in the recess 364 formed thereby, provides a generally continuous exterior surface of the baseball bat 320 when the handle portion 322 engages the barrel portion 324.

The components of the intermediate tapered section 326 tightly fit together to isolate vibrations which insulates the handle portion 322 from vibrations generated in the barrel portion 324 when a ball strikes the barrel portion 324. The length of the intermediate tapered section 326 will be varied based on the size and type of bat (e.g., adult baseball bat, youth baseball bat, softball bat or the like). The high strength bonding agent 362 (e.g. rubberized glue, rubber cement, etc.) may be applied to all joins to secure all the connections. The bonding agent 362 helps to dampen vibrations, fill in gaps and allow additional flexibility. The flexibility of the bonding agent 362 helps to give the bat 320 a whipping effect since the two materials that form, respectively, the handle and barrel portions 322, 324 flex at different rates (the barrel portion 324 flexing more than the handle portion 322) and the bonding agent 362 provides a flexible cushion along the interface of the sleeve 346, the ring 348, the handle portion 322 and the barrel portion 324.

A second end 366 of the barrel portion 324 is typically open and directed inward for acceptance and retention of a rigid cap or end plug 368 that increases the rigidity of the bat 320. The end plug 368 is typically comprised of urethane, polyurethane, Zytel or the like. The end plug 368 has a circumferential outer groove 370 which accepts an inwardly directed annular lip 372 of the barrel portion 324. The end plug 368 is then secured to the end 366 of the barrel portion 324 by inserting a number pairs of keys 374 disposed on opposite sides of the end plug 368 into slots or keyholes 376 disposed on opposite sides of the lip 372 and rotating the end plug 368 therein. Bonding agent 362 may be used to secure the end plug 368 in position. A recess 378 is formed on a top surface of the end plug 368 in order to allow a tool having a complimentary shape to the recess 378 engage the end plug 368 in order to secure the end plug 368 within the barrel 324. The end plug 368 includes a circumferential inner groove 380 within which a rigid ring 382 is at least partially disposed. The sleeve 346 at the intermediate section 326 blocks vibrations by itself, and in combination with the ring 382 within the end plug 368, the sleeve 346 and the ring 382 interact to create a larger sweet spot along the length of the barrel 324. The sleeve 346 and the ring 382, disposed at opposite ends 334, 366 of the barrel 324, cooperate to contain vibrations that occur when a ball hits the bat 320 as well as channel those vibrations in order to increase the volume of a desirable "ping" sound that occurs from the ball hitting the bat 320. The ring 382 is made of a 65D polyurethane material that allows a softer durometer material to be used in the end plug 368.

An example of several methods of manufacturing the bat 20, 120, 220, 320 of the present invention will now be described. It is to be understood that the methods used may be altered in some respects while still creating a bat 20, 120, 220, 320 having the desired characteristics. Also, certain dimensions, materials, temperatures, etc. may be altered depending upon the size, weight and intended use of the resulting bat 20, 120, 220, 320. The connection between the handle 22, 122, 222, 322 and barrel portions 24, 124, 224, 324 allows the balance between the handle 22, 122, 222, 322 and barrel portions 24, 124, 224, 324 to be adjusted so that the majority of the weight of the bat 20, 120, 220, 320 is at the intermediate section 26, 126, 226, 326. The position of the intermediate section 26, 126, 226, 326 along the length of the bat 20, 120, 220, 320 may be adjusted as well as the length and/or thickness of the intermediate section 26, 126, 226, 326. In general, the barrel portion 24, 124, 224, 324 has a minimum thickness of 0.070 inches and a maximum thickness of 0.115 inches. The thickness of the connection area of the bat 20, 120, 220, 320 is determined by the weight/size of the bat 20, 120, 220, 320.

The composite material handle portions 22, 122, 222, 322 may be manufactured using a variety of techniques. These techniques include, but are not limited to: resin transfer molding (RTM); vacuum resin transfer molding (VRTM); filament winding and wrapping technique. Using RTM, various layers of the composite material are pre-manufactured to from the handle portion 22, 122, 222, 322. Wrapping technique provides a layer-by-layer formation of the handle portion 22, 122, 222, 322 that allows the manufacturer to control the flexibility of the handle portion 22, 122, 222, 322. In general, the handle portion 22, 122, 222, 322 is formed by approximately sixteen to twenty layers of composite material, depending on fiber type, fiber thickness (0.001-0.003 inches), fiber area weight (FAW) and flex.

A metal tube, such as an aluminum alloy tube, is provided at predetermined lengths and weights prior to manufacturing. For purposes of the following example, an aluminum alloy tube is provided for the manufacture of the barrel portion 24, 124, 224, 324 for the bat 20, 120, 220, 320.

The metal tube is first thermally treated. This is often referred to in the art as an annealing process. The thermal treatment softens the metal by removing the stress resulting from cold working. This process is to be repeated after a certain amount of cold work has been performed on the metal tubes. Before each cold forming process, the temperature of an anneal oven is set at four hundred ten degrees Centigrade. The aluminum tube is heated in the oven at this temperature for approximately three hours. The oven temperature is then decreased by twenty degrees Centigrade per hour, after the three hour soak time, until the temperature of the tubes has reached twenty degrees Centigrade. The aluminum tube is then heated at a temperature of two hundred thirty degrees Centigrade for two hours, at which point the oven temperature is reset to one hundred forty degrees Centigrade. The tube is removed from the oven when the temperature of the oven has reached one hundred forty degrees Centigrade.

The tube is then cleaned. During the annealing process, an oxidation scale develops on the surface of the aluminum tube. An acid cleaning process is required to remove the oxidation scale. The tube is soaked in a sulfuric acid solution for approximately thirty minutes to remove the oxidation scale each time the tube is annealed.

The tube is then formed into the barrel portion 24, 124, 224, 324 of desired thickness, contour and length. This wall forming process is a cold working process. It is performed to obtain a wall of a desired thickness. Several cold forming passes may have to be performed depending upon several factors including metal type and the type of bat 20, 120, 220, 320 desired. In the instant example, the tube forming the aluminum barrel portion 24, 124, 224, 324 is subject to the cold working process on the outside diameter and the wall thickness simultaneously to obtain a wall thickness ranging from the minimum thickness of 0.070 inches to the maximum thickness of 0.115 inches. The barrel portion 24, 124, 224, 324 is then cleaned. A degreasing process is required to remove all lubricants and residue substances out of the aluminum barrel portion 24, 124, 224, 324. This is performed using an ultrasonic method with a detergent agent before and after the aluminum tube is annealed.

The barrel portion 24, 124, 224, 324 is then cut, trimmed and swaged to a desired length and contour. A thin end of the aluminum barrel portion 24, 124, 224, 324 is trimmed to a predetermined length. It is important to have the thin ends of the aluminum barrel portions 24, 124, 224, 324 squarely trimmed to avoid folding problems when the tubes are swaged by a rotary taper swager. The aluminum barrel portion 24, 124, 224, 324 is swaged with a rotary swaging machine to obtain the desired contour shape and wall thickness. In the instant example, the required wall thickness after swaging is generally a minimum thickness of 0.070 inches and a maximum thickness of 0.115 inches for the barrel portion 24, 124, 224, 324.

The tapered sleeve 46, 146, 246, 346 may be formed using conventional methods which may vary. The tapered sleeve 46, 146, 246, 346 is shaped to obtain a desired contoured shape that will later assist in giving the exterior surface of the bat 20, 120, 220, 320 a generally continuous appearance. After forming the rigid sleeve 46, 146, 246, 346, the handle portion 22, 122, 222, 322 can be molded with the sleeve 46, 146, 246, 346.

If necessary, after shaping, the barrel portion 24, 124, 224, 324 is cut to the desired length.

The barrel portion 24, 124, 224, 324 is then thermally treated, quenched and aged in order to obtain a T6/T7 Temper. It is commonly known in the art to expose metal or alloys to a heating and cooling treatment to obtain desired conditions, properties and an increase in strength. The barrel portion 24, 124, 224, 324 is heat treated to obtain the highest tensile and yield strengths. The required temperature and time for the solution heat treatment is twenty-seven minutes at a temperature of four hundred eighty degrees Centigrade. After the barrel portion 24, 124, 224, 324 is heat treated, they are quenched immediately with either air or water. Quenching is a controlled rapid cooling of a metal from an elevated temperature by contact with a liquid, gas or solid. Precipitation from solid solution results in a change in properties of the alloy, usually occurring rapidly at elevated temperatures. The barrel portion 24, 124, 224, 324 is aged in an oven for twelve hours at one hundred thirty five degrees Centigrade.

After aging, the tapered ends 34, 134, 234, 334 of the barrel portion 24, 124, 224, 324 are contoured by machining. The respective threads 142 and corrugations 242 of the barrel portions 124, 224 are machined to obtain the desired configuration and dimensions to closely receive the respective threads 140, corrugations 242 and other parts of the handle portions 122, 222. The end 34, 134, 234, 324 of the barrel portion 24, 124, 224, 324 is machined to achieve squareness and an angled exterior surface in order to obtain a snug mating with the handle portion 22, 122, 222, 322.

The barrel portion 24, 124, 224, 324 is then cleaned again. Due to the treatments, the barrel portions 24, 124, 224, 324 oxidizes. This oxidation is removed by an anodizing process. The barrel portion 24, 124, 224, 324 is anodized for five minutes. To eliminate all possible contaminations, the surface of the barrel portion 24, 124, 224, 324 is then thoroughly cleaned with methyl ethyl ketone.

At this point, the barrel portion 24, 124, 224, 324 is assembled as outlined above, with respect to FIGS. 1-19.

Thereafter, approximately a one half inch portion of the open barreled end 64, 164, 264, 366 is rolled inward at a ninety degree angle to accommodate the end plug 66, 166, 266, 368. If necessary, the protruded portion of the rolled portion is machined to achieve an opening of one and a quarter inches in diameter for installing the end plug 66, 166, 266, 368. The keyholes/slots 74, 174, 274, 376 are then machined into the lip 70, 170, 270, 372 and interior of the barrel portion 24, 124, 224, 324.

The bat 20, 120, 220, 320 is then polished and decorated. Any appropriate methods of polishing and decoration, as are well known in the art, can be applied. In the preferred embodiment, the outer surfaces of the barrel portion 24, 124, 224, 324 are exposed to sodium hydroxide to strip an anodize coating created during the manufacturing process as well as to prepare the outer surface for anodic coating process. Typically, the concentration of the sodium hydroxide is fifty grams per liter. The outer surface of the barrel portion 24, 124, 224, 324 is mechanically polished to obtain a mirror finish. The external surface of the barrel portion 24, 124, 224, 324 is then anodized. In the alternative, the external surface of the barrel portion 24, 124, 224, 324 may be painted, chromed, powder-coated, or covered by some other method of decorative coating. The outer surface of the barrel portion 24, 124, 224, 324 may be decorated with a graphic by using various methods such as silkscreening, heat transferring, or pad stamping. The handle portion 22, 122, 222, 322 may also be decorated using same/similar techniques.

The bat 20, 120, 220, 320 is completed by attaching the knob 28, 128, 228, 328 typically by gluing the knob 28, 128, 228, 328 to an open end of the handle portion 22, 122, 222, 322 opposite the tapered end 32, 132, 232, 332. The grip 30, 130, 230, 330 and the end plug 66, 166, 266, 368 are also installed to finish the bat 20, 120, 220, 320.

In the alternative, the above described method of manufacturing the bat 20, 120, 220, 320 may be varied. For example, physical characteristics of the bat 20, 120, 220, 320 such as the length, wall thickness or diameter may be increased or decreased.

An important feature of the bat 20, 120, 220, 320 is the balance of the bat 20, 120, 220, 320. The balance of the bat affects a user's control of the bat 20, 120, 220, 320. The length L, thickness t and position P of the intermediate section 26, 126, 226, 326 of the bat 20, 120, 220, 320 affects the balance of the bat 20, 120, 220, 320, as seen in FIGS. 4, 6, 8 and 16, respectively.

Although constructed from affordable medium to high strength, light weight, and commercially available materials, the bat 20, 120, 220, 320 of the present invention offers the performance and advantages of expensive and high strength materials. The bat 20, 120, 220, 320 also dampens the vibrations created when traditional metal bats hit the ball that would otherwise sting the hitter's hand when a bat contacts a ball. Premature longitudinal cracking of the barrel portion 24, 124, 224, 324 caused in traditional bats with thin wall thicknesses and high stress conditions, is avoided in the present invention.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A process for assembling a multi-component baseball bat, comprising the steps of:

disposing a rigid sleeve coaxially over a portion of an elongate composite handle, the rigid sleeve encircling a second end of the handle and extending toward a first end of the handle;

positioning a ring near a second end of a bat barrel;

inserting a first end of the bat barrel into the second end of the handle; and securing the first end of the bat barrel within the second end of the handle, wherein the securing step includes the step of forming a continuous tapered exterior surface of the baseball bat with the barrel, handle and sleeve.

2. The process of claim 1, wherein the inserting step includes the step of enveloping a section of the barrel within the second end of the handle.

3. The process of claim 1, wherein the disposing step includes the steps of forming the rigid sleeve and molding the handle with the sleeve.

4. The process of claim 1, wherein the disposing step includes the step of receiving the sleeve within an annular recess in the handle.

5. The process of claim 1, wherein the securing step includes the step of adhering the barrel to the handle.

6. The process of claim 1, wherein the securing step includes the step of adhering the barrel to the sleeve.

7. The process of claim 1, wherein the securing step includes the step of threadedly engaging the first end of the barrel and the second end of the handle to define an intermediate tapered section.

8. The process of claim 1, including the step of attaching a grip to the handle.

9. The process of claim 1, including the step of disposing a cap over an open second end of the bat barrel.

10. The process of claim 9, wherein the cap disposing step includes the step of coaxially disposing the ring within the cap.

11. The process of claim 1, including the step of disposing a second ring within the sleeve.

12. A process for assembling a multi-component baseball bat, comprising the steps of:

disposing a rigid sleeve coaxially over a portion of an elongate composite handle, the rigid sleeve encircling a second end of the handle and extending toward a first end of the handle;

receiving the sleeve within an annular recess in the handle;

positioning a ring near a second end of a bat barrel;

inserting a first end of the bat barrel into the second end of the handle;

securing the first end of the bat barrel within the second end of the handle; and forming a continuous tapered exterior surface of the baseball bat with the barrel, handle and sleeve.

13. The process of claim 12, wherein the inserting step includes the step of enveloping a section of the barrel within the second end of the handle.

14. The process of claim 12, wherein the disposing step includes the steps of forming the rigid sleeve and molding the handle with the sleeve.

15. The process of claim 12, wherein the securing step includes the step of adhering the barrel to the handle.

16. The process of claim 12, wherein the securing step includes the step of adhering the barrel to the sleeve.

17. The process of claim 12, wherein the securing step includes the step of threadedly engaging the first end of the barrel and the second end of the handle to define an intermediate tapered section.

18. The process of claim 12, including the step of attaching a grip to the handle.

19. The process of claim 12, including the step of disposing a cap over an open second end of the bat barrel.

20. The process of claim 19, wherein the cap disposing step includes the step of coaxially disposing the ring within the cap.

21. The process of claim 12, including the step of disposing a second ring within the sleeve.

22. A multi-component baseball bat, comprising:

an elongate composite handle having opposite first and second ends;

an elongate barrel having opposite first and second ends, the first end of the barrel being disposed within the second end of handle;

means for securing the first end of the barrel within the second end of the handle;

a ring disposed near the second end of the barrel;

a rigid sleeve encircling the second end of the handle and extending toward the first end of the handle; and a cap disposed on the second end of the barrel.

23. The baseball bat of claim 22, wherein the sleeve is adhered to an exterior of the handle and barrel.

24. The baseball bat of claim 22, wherein the securing means includes a section of the handle enveloping an end of the barrel.

25. The baseball bat of claim 22, wherein the securing means includes an annular recess in the handle for receiving the sleeve therein.

26. The baseball bat of claim 22, wherein a portion of the handle is disposed between the sleeve and barrel.

27. The baseball bat of claim 22, wherein the first end of the barrel and the second end of the handle threadedly engage each other.

28. The baseball bat of claim 22, including a layer of adhesive disposed between the first end of the barrel and the second end of the handle.

29. The baseball bat of claim 22, wherein the ring is coaxially disposed within the cap such that the ring and sleeve contain vibrations within the barrel.

30. The baseball bat of claim 22, wherein the sleeve comprises, at least in part, an intermediate tapered section between the barrel and handle.

31. The baseball bat of claim 22, including a second ring disposed within the sleeve.

32. A multi-component baseball bat, comprising:

an elongate composite handle having opposite first and second ends;

an elongate barrel having opposite first and second ends, the first end of the barrel being disposed within the second end of handle;

means for securing the first end of the barrel within the second end of the handle such that a section of the handle envelopes an end of the barrel;

a ring disposed near the second end of the barrel; and a rigid sleeve encircling the second end of the handle and extending toward the first end of the handle; wherein the sleeve comprises, at least in part, an intermediate tapered section between the barrel and handle, and wherein a portion of the handle is disposed between the sleeve and barrel; and wherein the securing means includes an annular recess in the handle for receiving the sleeve therein.

33. The baseball bat of claim 32, wherein the sleeve is adhered to an exterior of the handle and barrel.

34. The baseball bat of claim 32, wherein the first end of the barrel and the second end of the handle threadedly engage each other.

35. The baseball bat of claim 32, including a layer of adhesive disposed between the first end of the barrel and the second end of the handle.

36. The baseball bat of claim 32, including a second ring disposed within the sleeve.

37. A process for assembling a multi-component baseball bat, comprising the steps of:

disposing a rigid sleeve coaxially over a portion of an elongate composite handle, the rigid sleeve encircling a second end of the handle and extending toward a first end of the handle;

positioning a ring near a second end of a bat barrel; and inserting a first end of the bat barrel into the second end of the handle;

wherein the disposing step includes the steps of forming the rigid sleeve and molding the handle with the sleeve.

38. A process for assembling a multi-component baseball bat, comprising the steps of:

disposing a rigid sleeve coaxially over a portion of an elongate composite handle, the rigid sleeve encircling a second end of the handle and extending toward a first end of the handle;

positioning a ring near a second end of a bat barrel;

inserting a first end of the bat barrel into the second end of the handle; and securing the first end of the bat barrel within the second end of the handle;

wherein the disposing step includes the step of receiving the sleeve within an annular recess in the handle.

39. A process for assembling a multi-component baseball bat, comprising the steps of:

disposing a rigid sleeve coaxially over a portion of an elongate composite handle, the rigid sleeve encircling a second end of the handle and extending toward a first end of the handle;

positioning a ring near a second end of a bat barrel;

inserting a first end of the bat barrel into the second end of the handle;

securing the first end of the bat barrel within the second end of the handle; and disposing a cap over an open second end of the bat barrel.

40. The process of claim 39, wherein the cap disposing step includes the step of coaxially disposing the ring within the cap.

41. A multi-component baseball bat, comprising:

an elongate composite handle having opposite first and second ends;

an elongate barrel having opposite first and second ends, the first end of the barrel being disposed within the second end of handle;

means for securing the first end of the barrel within the second end of the handle;

a ring disposed near the second end of the barrel; and a rigid sleeve encircling the second end of the handle and extending toward the first end of the handle;

wherein the securing means includes an annular recess in the handle for receiving the sleeve therein.

42. A multi-component baseball bat, comprising:

an elongate composite handle having opposite first and second ends;

an elongate barrel having opposite first and second ends, the first end of the barrel being disposed within the second end of handle;

means for securing the first end of the barrel within the second end of the handle such that a section of the handle envelopes an end of the barrel;

a ring disposed near the second end of the barrel; and a rigid sleeve encircling the second end of the handle and extending toward the first end of the handle; wherein the sleeve comprises, at least in part, an intermediate tapered section between the barrel and handle;

wherein the securing means includes an annular recess in the handle for receiving the sleeve therein.

43. A multi-component baseball bat, comprising:

an elongate composite handle having opposite first and second ends;

an elongate barrel having opposite first and second ends, the first end of the barrel being disposed within the second end of handle;

means for securing the first end of the barrel within the second end of the handle such that a section of the handle envelopes an end of the barrel;

a ring disposed near the second end of the barrel;

a rigid sleeve encircling the second end of the handle and extending toward the first end of the handle, wherein the sleeve comprises, at least in part, an intermediate tapered section between the barrel and handle; and a cap disposed on the second end of the barrel.

44. The baseball bat of claim 43, wherein the ring is coaxially disposed within the cap such that the ring and sleeve contain vibrations within the barrel.

45. The baseball bat of claim 44, including a second ring disposed within the sleeve.

* * * * *